US006179498B1

(12) United States Patent
Tsukada

(10) Patent No.: US 6,179,498 B1
(45) Date of Patent: Jan. 30, 2001

(54) PRINTER AND CONTROL METHOD THEREFOR

(75) Inventor: Toshihiro Tsukada, Suwa (JP)

(73) Assignee: Seiko Epson Corporation, Tokyo (JP)

( * ) Notice: Under 35 U.S.C. 154(b), the term of this patent shall be extended for 0 days.

(21) Appl. No.: 09/406,328

(22) Filed: Sep. 27, 1999

Related U.S. Application Data

(62) Division of application No. 08/818,475, filed on Mar. 13, 1997, now abandoned.

(30) Foreign Application Priority Data

Mar. 14, 1996 (JP) ..... 8-57940

(51) Int. Cl.[7] ..... B41J 11/42
(52) U.S. Cl. ..... 400/582; 400/708; 400/56
(58) Field of Search ..... 400/582, 56, 611, 400/613, 617, 621, 708, 630

(56) References Cited

U.S. PATENT DOCUMENTS

| | | | |
|---|---|---|---|
| 4,667,208 | 5/1987 | Shiraki et al. . | |
| 4,844,631 | 7/1989 | Feron et al. . | |
| 5,061,095 | 10/1991 | Asai et al. . | |
| 5,062,722 | 11/1991 | Shiozaki et al. . | |
| 5,118,208 | 6/1992 | Kitahara et al. . | |
| 5,133,611 | 7/1992 | Nakajima . | |
| 5,156,465 | 10/1992 | Kakiuchi . | |
| 5,346,322 * | 9/1994 | Okamura | 400/708 |
| 5,480,238 * | 1/1996 | Nakano et al. | 400/708 |

FOREIGN PATENT DOCUMENTS

| | | |
|---|---|---|
| 0 473 788 | 3/1992 | (EP) . |
| 2-251474 | 10/1990 | (JP) . |
| 4-022656 | 1/1992 | (JP) . |
| 6-001044 | 1/1994 | (JP) . |
| 7-017672 | 1/1995 | (JP) . |
| 8-108587 | 4/1996 | (JP) . |

* cited by examiner

*Primary Examiner*—Eugene Eickholt
(74) *Attorney, Agent, or Firm*—Mark P. Watson

(57) ABSTRACT

A printer and control method therefor improve the operability of loading recording paper to the printer, and specifically enable recording paper to be loaded reliably and easily with a simple operation. Opening of the release lever that is operated to load recording paper in the printer is detected to automatically start a recording paper feed operation. When closing of the release lever is then detected, recording paper transportation is stopped and the recording paper loading process is terminated. A recording paper detector is also provided to detect the presence of recording paper, and the recording paper transport amount is then controlled based on recording paper detector output. When a predetermined amount of recording paper is transported through the printer, recording paper transportation is stopped and loading the recording paper is completed.

14 Claims, 6 Drawing Sheets

PRINTER AND CONTROL METHOD THEREFOR

CROSS REFERENCE TO RELATED APPLICATIONS

This application is a division of and now abandoned application Ser. No. 08/818,475 filed Mar. 13, 1997, which is incorporated by reference herein in its entirety.

BACKGROUND OF THE INVENTION

1. Field of the Invention

The invention relates to a printer requiring recording paper replenishment, and relates particularly to a printer comprising a release lever for opening the recording paper path and to a control method for such printer.

2. Description of the Related Art

In printers in which the gap between the print head and platen is narrow, the recording paper can easily be caught between the print head and platen when loading the recording paper. A release lever is typically provided to prevent this by increasing the distance between the print head and platen when the recording paper is loaded, thereby making it easier to insert the recording paper.

In line thermal printers, in particular, the print head touches the platen, thus effectively closing the recording paper path in this area and making it difficult to feed the recording paper between the print head and platen. It is therefore necessary to separate the print head from the platen, thereby opening the recording paper path, before inserting the recording paper.

FIG. 6 shows the mechanism of a line thermal printer. In the mechanism shown in FIG. 6 the release lever 2 operates in conjunction with the print head 6. During printing, print head 6 is pressed against platen 4 with the recording paper disposed therebetween by means of a coil spring or other energized means. This assures tight contact between the recording paper and print head 6, and enables the effective transfer of heat from the print elements in print head 6 to the recording paper.

When recording paper must be loaded, release lever 2 is operated to lift print head 6 from platen 4, thereby forming a gap through which the recording paper can be passed. Note that this operation is referred to below as "opening" the release lever. The recording paper is then inserted through the gap between platen 4 and paper feed roller 5, which is embedded in paper guide 9, and paper feed knob 3 linked to platen 4 is manually turned to advance the recording paper caught between platen 4 and paper feed roller 5. To thus load the recording paper it is necessary for the operator to hold and insert the paper with one hand while turning paper feed knob 3 with the other hand. After advancing the recording paper the required distance, release lever 2 is again operated to close the gap between print head 6 and platen 4 and complete the recording paper loading process. Note that this last operation of release lever 2 to close the gap is also referred to below as "closing" the release lever.

Printers such as described above have become a widely used peripheral device connected to personal computers (PC) and other information processing devices, and people that have never before operated such printers are increasingly exposed to the need and opportunity to use such printers. This widespread use of printers has increased demand for greater ease of use, particularly in the frequently performed, trouble-prone procedure used to load recording paper. Recording paper is one of the most common printer consumables, and the roll paper used in printers that are used in point-of-sale (POS) and electronic cash register (ECR) stations must be replaced right at the checkout counter. Because the recording paper must often be replenished, i.e. installed, while customers are waiting, it is necessary to complete the installation quickly and reliably in order to minimize the customer waiting time.

The conventional method of installing recording paper as described above is, however, both complicated and time-consuming. It is not intuitively understood that paper feed knob 3, shown in FIG. 6, must be turned while inserting the paper. It is therefore necessary to educate and train workers to properly install the recording paper.

It can also be difficult to hold and insert the recording paper with one hand, making sure the paper stays straight, while turning the paper feed knob with the other hand to advance the paper.

OBJECTS OF THE INVENTION

An object of the present invention is therefore to resolve the aforementioned problems by providing a printer and method for easily inserting and loading the recording paper in the printer.

SUMMARY OF THE INVENTION

To achieve the above and other objects of the invention, a printer according to the invention has a printing means, a recording paper path for transporting the recording paper passed the printing means, a path closing means situated in the recording paper path for holding and releasing the recording paper, a recording paper transportation means capable of transporting the recording paper along the recording paper path, and an open path detection means for detecting whether the path closing means is open or closed. When the printing means is driven to print to the recording paper, the path closing means is closed, and when recording paper is to be loaded, the path closing means is opened. Therefore, when the recording paper path is detected to be open by the open path detection means, the recording paper transportation means is activated to advance the recording paper.

More specifically, a printer having at least a printing means, a platen disposed opposite the printing means, a path closing means for opening and closing a recording paper path formed between the printing means and the platen, and a recording paper transportation means capable of transporting the recording paper along the recording paper path, comprises according to the invention an open path detection means for detecting whether the recording paper path that is opened and closed by the path closing means is open or closed, and starts the recording paper transportation means when the open path detection means detects that the path closing means and recording paper path are open.

Each of the preceding configurations may further comprise a recording paper detection means for detecting the presence of recording paper in the recording paper path, and a transport amount detection means for detecting the transportation amount performed by the recording paper transportation means operation. When thus configured, the paper transport control means stops the recording paper transportation means as required based on the output from the recording paper detection means and the transport amount detection means. It is a further advantage of the present invention that the paper transport control means stops operation of the recording paper transportation means based on the detection of a first predetermined recording paper transport amount when there is no recording paper detected and a second predetermined recording paper transport amount when recording paper is detected.

It is a further advantage of the printer of the invention that it includes a stop state indication means for indicating that the recording paper transportation means has stopped when the recording paper transportation means stops due to detection of the first predetermined recording paper transport amount in the no-paper state.

It is yet a further advantage in that the present invention includes a restart command means for commanding the recording paper transportation means to restart when a stop state is indicated by the stop state indication means.

It is also an advantage of the printer of the invention that it includes an automatic paper cutter for cutting off the end of the recording paper when the recording paper transportation means stops based on detection of the second predetermined recording paper transport amount when paper is present and the path closing means is detected to be closed by the open path detection means.

The method and operation of the invention thus comprised is described below.

A release lever is operated when loading the recording paper. Opening or closing of this release lever is detected to automatically execute a recording paper feed operation. More specifically, when a detector detecting the open or closed state of the release lever detects that the release lever is open, a recording paper feed operation is initiated. It is therefore not necessary to manually turn the paper feed knob to advance the recording paper when recording paper is loaded. The recording paper feed operation is automatically executed whenever recording paper is loaded because the release lever must be operated to insert and load the recording paper. This also frees both hands to hold and insert the recording paper in the insertion opening, and thus makes inserting the recording paper simple and reliable.

A paper detector is also provided to detect whether the recording paper has been inserted during the recording paper feed operation, and to determine how far the recording paper has been advanced. This also makes it possible to automatically advance the recording paper a known required distance, thereby eliminating problems caused by insufficiently advancing the recording paper.

Furthermore, if the recording paper is not inserted during the recording paper feed operation within a predetermined time, or if insufficient paper is inserted to advance a predetermined length of recording paper, the recording paper feed operation can also be automatically stopped. Automatically stopping the recording paper feed operation avoids continued needless operation of the recording paper transportation means, the incumbent wasteful consumption of electricity, and needless heating and wear of mechanical parts.

The operator is also notified that the recording paper has not been inserted by providing a means of flashing an LED or activating some other notification means. Considering the situation in which the operator notices the flashing LED or other notification means and thus realizes that the recording paper is not inserted, the present invention also provides the user with the opportunity to re-insert the recording paper. This can be accomplished by preferably providing a paper feed switch, for example.

The operator can then press the paper feed switch, for example, to effect the same operation executed when the release lever is opened. If such means is not provided, it is simply necessary to close the release lever once and then open the release lever again to automatically restart the paper loading process.

If the printer comprises an automatic paper cutter, the present invention automatically cuts off any excess paper after the recording paper is loaded by operating the automatic cutter when closing of the release lever is detected.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The preferred embodiments of the present invention are described below with reference to the accompanying figures.

Figure 1:
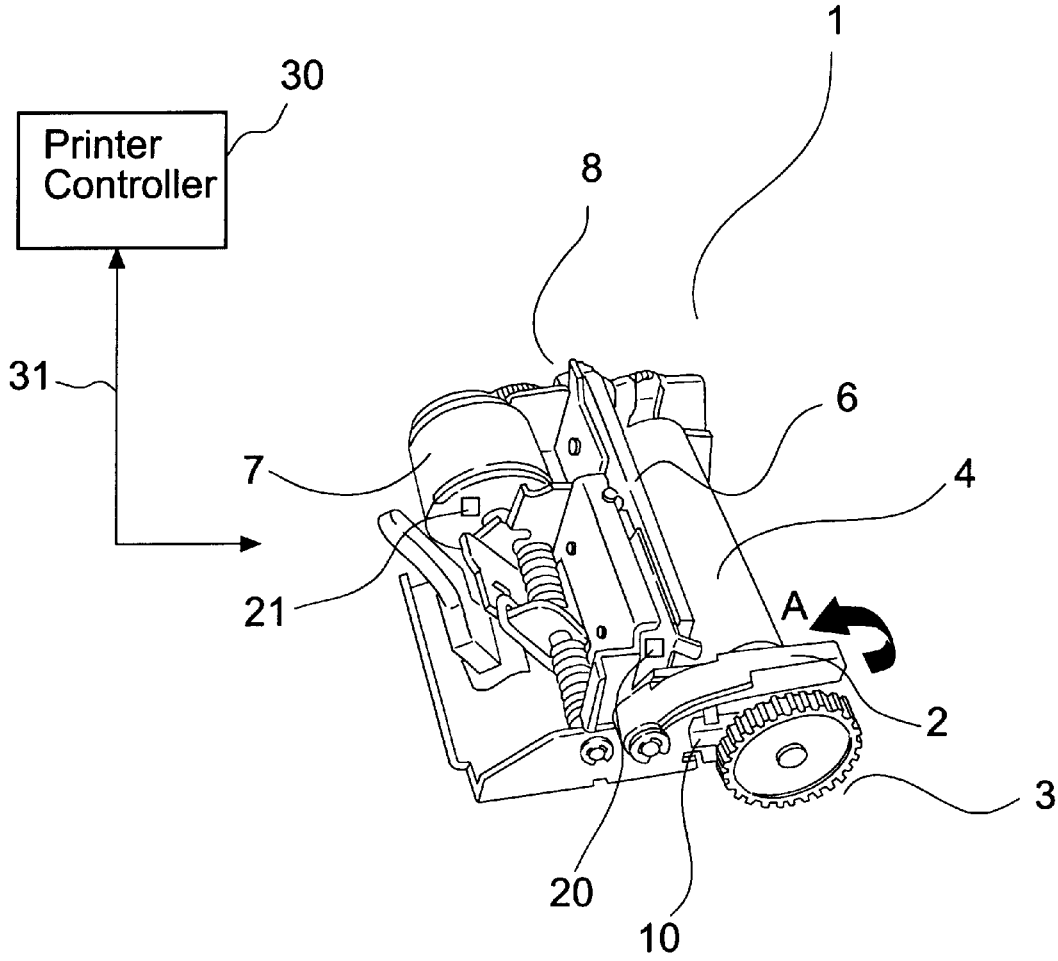
FIG. 1 is a simplified view of a printer mechanism according to the preferred embodiment of the invention.

FIG. 1 is a simplified view of mechanism 1 of printer 18 according to a first embodiment of the invention.

Figure 2:
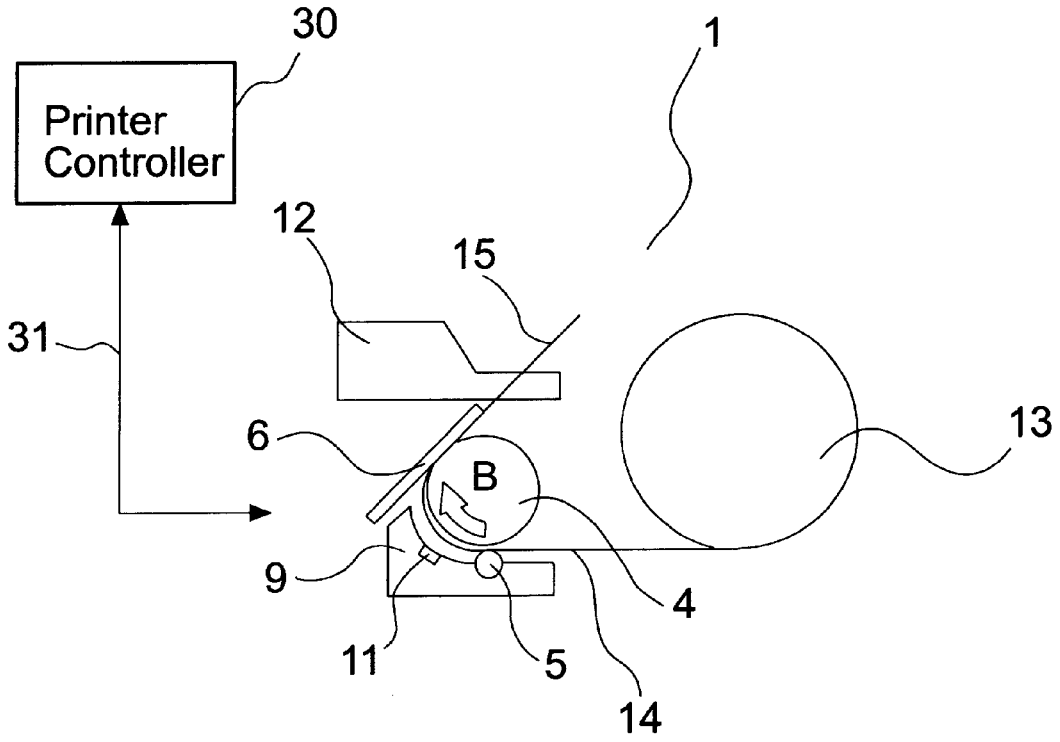
FIG. 2 is a simplified side cross sectional view of an alternative embodiment of the invention.

FIG. 2 is a simplified side cross sectional view of mechanism 1 of printer 18 in a second embodiment of the invention. Note that mechanism 1 of printer 18 in FIG. 2 is the same as that shown in FIG. 1 with the addition of photosensor (paper detector) 11 used to detect the recording paper, and automatic paper cutter 12.

Figure 3:
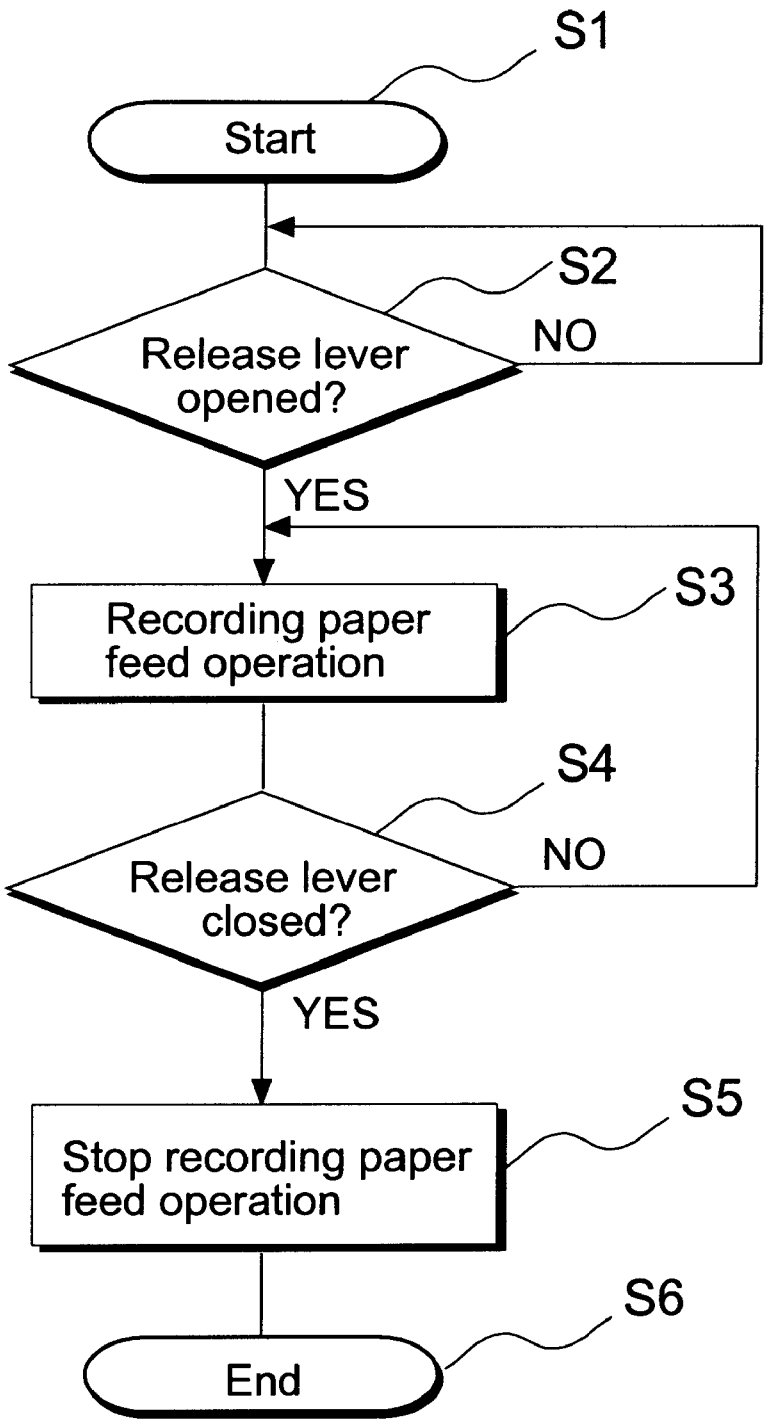
FIG. 3 is a flow chart of the recording paper loading operation executed by the printer according to the first embodiment shown in FIG. 1.

FIG. 3 is a flow chart of the recording paper loading operation accomplished with the printer of the first embodiment shown in FIG. 1.

Figure 4:
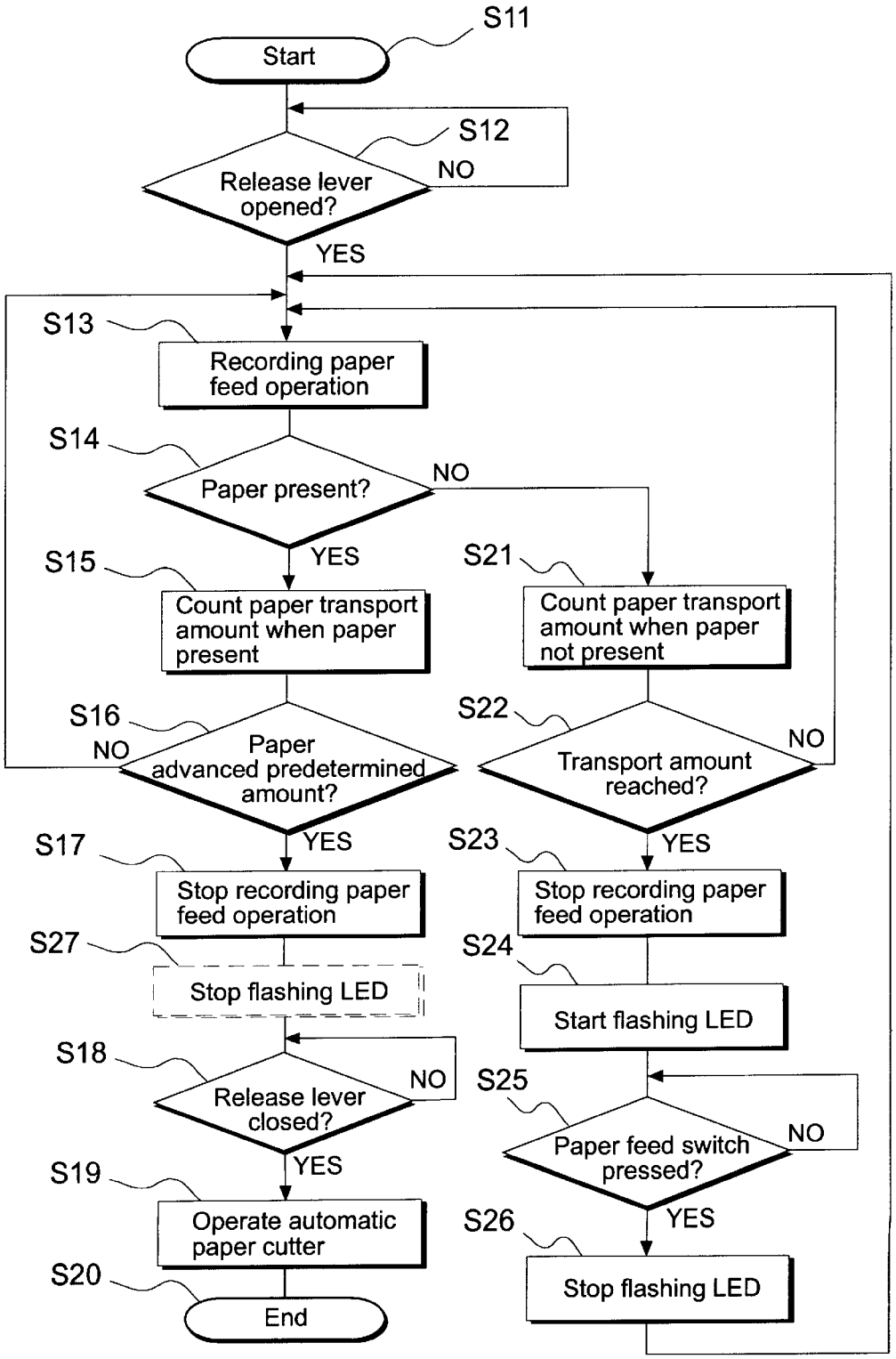
FIG. 4 is a flow chart of the recording paper loading operation executed by the printer according to the second embodiment shown in FIG. 2.

FIG. 4 is a flow chart of the process executed in the printer of the second embodiment shown in FIG. 2.

Figure 5:
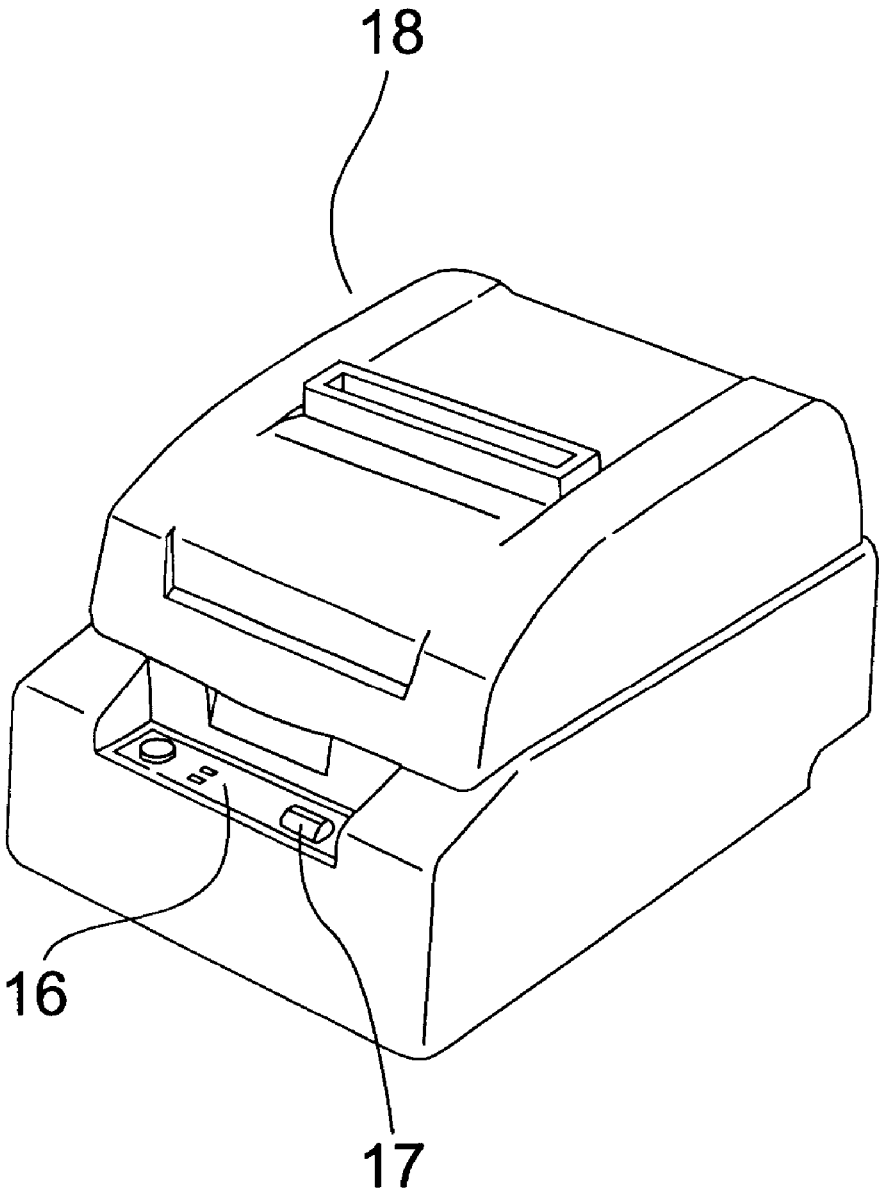
FIG. 5 is an external view of a printer according to the present invention.
Figure 6:
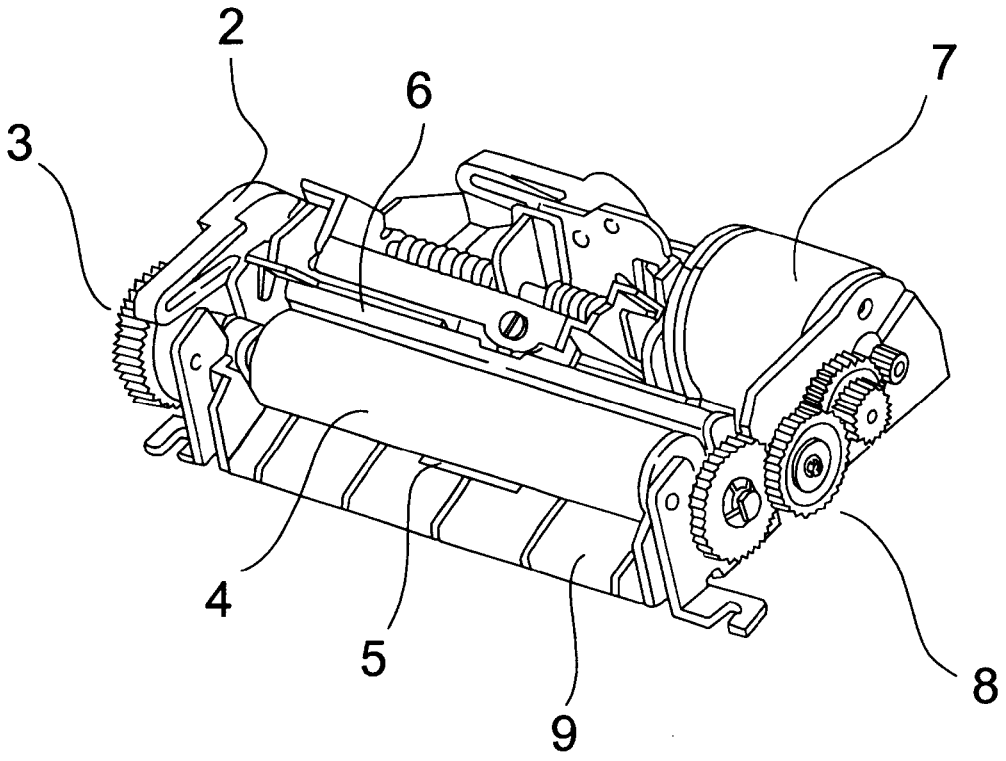
Prior Art FIG. 6
FIG. 6 is a simplified view of a printer mechanism according to the prior art.

FIG. 5 is an external view of printer 18 integrating printer mechanism 1 according to the present invention.

Printer 18 of the invention is built using mechanism 1 shown in FIG. 1. Print head 6 and release lever 2 are a linked assembly and open and close together. More specifically, when release lever 2 is moved in the direction of arrow A to open the gap between print head 6 and platen 4, print head 6 is lifted off platen 4. This operation is also called "opening" release lever 2 below. When release lever 2 is moved in the direction opposite arrow A to close the gap, print head 6 is pressed against platen 4 once again. This operation is also called "closing" release lever 2 below. This closed position is shown in FIG. 2.

Loading the recording paper is accomplished by opening release lever 2 and lifting print head 6 off platen 4. To print, release lever 2 is closed again to press print head 6 against platen 4. When release lever 2 is closed, lever open sensor 10 is ON, and when release lever 2 is open, lever open sensor 10 is OFF. It is therefore possible to determine whether release lever 2 is open or closed by reading the detection state of lever open sensor 10.

It should be noted that while a microswitch is used for lever open sensor 10 detecting the open/closed state of release lever 2 in this embodiment, the invention shall not be so limited and a variety of other sensors, including a photointerrupter, can be alternatively used.

Alternatively, the recording paper path between the print head 6 and platen 4 can be detected as open or closed, for example with microswitch 20 that detects the lifted position of print head 6.

The recording paper feed operation is accomplished by driving stepping motor 7, and transferring the rotational drive power of stepping motor 7 through transfer gear set 8 to platen 4.

A mechanism further comprising automatic paper cutter 12, paper feed roller 5, and paper detector 11 is shown in FIG. 2. Paper feed roller 5 and paper detector 11 are provided in paper guide 9 facing the recording paper path. Recording paper 14 pulled off paper roll 13 is held between platen 4 and paper feed roller 5, and is advanced when platen 4 rotates in the direction of arrow B.

Paper detector 11 is a photoreflector that detects the passage of recording paper 14 near paper detector 11 from the difference in the reflectance of recording paper 14 and platen 4.

How far the recording paper has been advanced, i.e., the paper transportation amount, is calculated from the number of steps stepping motor 7 is driven based on the unit transportation amount corresponding to one step motion of stepping motor 7. Alternatively, it can also be determined, using a rotary encoder 21 driven by stepping motor 7, for example.

Automatic paper cutter 12 is mounted above print head 6, and cuts the excess end of recording paper 15 fed out from the printer by the recording paper feed operation.

Printer controller 30 is schematically represented in FIGS. 1 and 3 as connected to the various elements of the printer through signal and control lines 31. For simplicity, individual signal connections are not shown but, as will be readily appreciated, printer controller 30 will be connected to sensors/detectors 10, 11, 20 and 21, motor 7 and cutter 12 and all elements under the control of or monitoring by controller 30. Printer controller 30 can be any programmable controller, having a processor, memory, input/output interface, etc. as is well known and can be programmed to execute and control the elements of the printer in accordance with the invention as described herein.

The process whereby the recording paper is loaded into the above printer is described below with reference to the flow chart in FIG. 3.

This process starts (S1) when the power is turned on, and it is then immediately determined whether release lever 2 is open by checking the on/off state of lever open sensor 10 (S2). If release lever 2 is not open, the procedure continues to loop through this step (S2). Alternatively to checking the on/off state of release lever 2, the open/closed state of the paper path can be checked by checking whether or not microswitch 20, for example, detects that print head 6 is in the lifted position. In the following discussion, for simplicity, only the release lever is checked but the alternative of checking the position of printer head 6 is equally applicable. Other necessary printer control processes can be executed by printer controller 30 during this standby period.

When the operator opens release lever 2, release lever opening is detected by lever open sensor 10 (S2), and control passes to start the recording paper feed operation (S3). Note that the recording paper feed operation is accomplished by driving stepping motor 7 to rotate print head 6. Once the recording paper feed operation starts it is determined whether release lever 2 is closed again by checking the on/off state of lever open sensor 10 (S4). The recording paper feed operation (S3) continues until release lever 2 is closed again.

If the operator inserts recording paper between paper feed roller 5 and platen 4 during this time, the recording paper is automatically fed into the printer by the recording paper feed operation (S3) because platen 4 rotates in the same direction as the recording paper insertion direction. Note that it is not necessary to manually rotate a paper feed knob to insert the recording paper, and the operator can therefore hold the recording paper with both hands to assure that the recording paper is inserted in the correct orientation.

After the recording paper is inserted and advanced a sufficient distance, the operator closes release lever 2. The printer thus detects by means of lever open sensor 10 that release lever 2 is closed (S4), stops driving stepping motor 7, stops the recording paper feed operation (S5), and terminates the process (S6).

It is therefore possible by means of the printer according to the present embodiment of the invention to quickly and reliably load recording paper by simply operating a release lever 2 and inserting the recording paper, and it is not necessary to manually turn a paper feed knob. The recording paper can also be simply and reliably inserted because it can be held with both hands.

The operation of a printer according to the second embodiment shown in FIG. 2 is described next with reference to the flow chart in FIG. 4.

This embodiment comprises paper detector 11 as shown in FIG. 2, and the condition for initiating the process shown in FIG. 4 is that recording paper 14 is initially not detected by paper detector 11. This condition is used to distinguish the recording paper replenishing or loading process from the normal printing process. More specifically, it is often necessary to operate release lever 2 to open the print head during normal printing processes (with paper detected by detector 11) in order to clean the print head or remove foreign matter or paper jams. However, there should be no recording paper in the printer when the recording paper loading operation is performed. As a result, the process shown in FIG. 4 is only executed when paper detector 11 initially detects that there is no recording paper in the printer.

When the process starts (S11) it is determined whether release lever 2 is open by checking the on/off state of lever open sensor 10 (S12). If release lever 2 is not open, the procedure continues to loop through this step (S12). The recording paper feed operation starts (S13) after lever open sensor 10 detects that release lever 2 has been opened (S12). Paper detector 11 continues to detect whether recording paper is present (S14) during the recording paper feed operation.

If recording paper is detected, the recording paper has been transported from the insertion opening, i.e., from paper feed roller 5 and platen 4, to paper detector 11. The distance the recording paper is advanced thereafter, i.e., the paper transportation amount, is then counted (S15). This is accomplished by counting the number of steps stepping motor 7 is driven from when the recording paper is first detected.

It is next determined whether the paper transport amount in the paper-present state has reached a predetermined value (S16), and the recording paper feed operation (S13) is continued until this predetermined value is reached. More specifically, the recording paper is automatically advanced through the printer when the operator inserts the recording paper, and the recording paper feed operation is continued until the paper transportation amount in the paper-present state reaches a predetermined value. The recording paper feed operation is then stopped automatically (S17).

It is then determined whether release lever 2 has been closed by checking the on/off state of lever open sensor 10 (S18), and this step repeats until release lever 2 is closed. Once release lever 2 is closed, automatic paper cutter 12 is operated (S19) to cut off the excess recording paper 15 fed out from the printer, and the process terminates (S20).

While this automatic paper cutting operation is preferably executed with the recording paper held firmly between print head 6 and platen 4, the invention shall not be so limited. Specifically, the recording paper can be cut by automatic paper cutter 12 before release lever 2 is closed.

Note that because the paper feed operation is stopped automatically it is not necessary for the operator to manually confirm that the recording paper has been advanced an appropriate distance and then close release lever 2 to stop the feed operation.

Furthermore, the need for the operator to manually cut off any excess paper with scissors or other means can be eliminated by automatically operating automatic paper cutter 12. In this case the operator only needs to remove the cut paper end.

If it is determined that paper is not present (S14), the no-paper state paper transport amount is then counted (S21), again by counting the number of steps stepping motor 7 is driven. It is then determined whether the no-paper state paper transportation amount has reached a predetermined value (S22). If it has not, the recording paper feed operation (S13) continues while waiting for recording paper insertion.

However, if the operator does not insert the recording paper and the no-paper state paper transportation amount reaches a predetermined value (S22), the feed operation is automatically stopped (S23). This prevents the feed operation from continuing endlessly until the recording paper is inserted, prevents unnecessary shortening of the printer life, and reduces power consumption.

As shown in FIG. 5 printer 18 also comprises LED 16 and paper feed switch 17. When the recording paper feed operation is stopped automatically (S23), LED 16 starts flashing to notify the operator (S24) that the recording paper could not be loaded because the operator has not inserted the recording paper. It should be noted that the invention shall not be limited to an LED for this notification means, and that the user can be notified by sounding a buzzer or using other means. It will also be obvious that if the printer is connected to a host device, other commonly used means such as sending a status signal to the host device to notify the user can be used. In the present example the LED notification means 16 continues flashing (S24) until paper feed switch 17 is pressed (S25).

If the operator notices that the recording paper was not loaded and wishes to reload the recording paper, the operator can simply press paper feed switch 17. This causes LED 16 to stop flashing (S26), returns control to the main routine, i.e., the recording paper feed operation (S13), and restarts the paper loading process.

With the control process described above, the same paper feed operation executed when release lever 2 is first opened is executed after the printer failed to load the recording paper and the operator then pressed paper feed switch 17. The recording paper feed operation could therefore be repeated. Note that LED flashing can also be stopped after the paper loading process is completed (S27) rather than as a result of the paper feed switch being pressed. This paper feed switch function also enables the paper loading process to be repeated without the need to close and then re-open release lever 2.

Note, further, that if paper feed switch 17 is not used it is possible to detect whether release lever 2 has been closed by checking lever open sensor 10 after the paper feed operation is stopped (S23), and then loop back to the start of the process (S11) once release lever 2 is closed. With this operation the recording paper feed operation can be repeated by simply closing and then re-opening release lever 2.

It should be further noted that while the invention has been described with reference to a line thermal printer, the invention shall not be so limited. From the above disclosure it will be obvious to those skilled in the art that the invention can be applied with all printers in which part of the recording paper path is opened and closed when loading the recording paper.

The invention shall furthermore not be limited to using recording paper supplied in roll form, and the invention can also be used with printers using cut sheet forms and fan-fold paper.

As described above, a printer and control method therefor according to the invention can detect release lever opening and closing to automatically execute a recording paper feed operation, thereby enabling the operator to reliably load recording paper with a simple operation.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printer comprising a print head, a platen disposed opposite to the print head, the print head and the platen forming a path closing section, a recording paper path through which recording paper is transported past the path closing section, a lever for manually opening the path closing section to release the recording paper and for closing the path closing section to hold the recording paper, and a recording paper transport for transporting the recording paper along the recording paper path, further comprising:

an open path detector for detecting that the path closing section is closed to hold the recording paper when the lever is in a first position, and for detecting that the path closing section is open to release the recording paper when the lever is in a second position;

a paper transport controller responsive to the open path detector for starting the recording paper transport past the path closing section when the open path detector detects that the path closing section is open;

a recording paper detector that detects the presence of recording paper in the recording paper path;

a transport amount detector that detects the transport amount performed by the recording paper transport; and the paper transport controller being responsive to the recording paper detector and the transport amount detector for stopping the recording paper transport when no recording paper is detected and a first predetermined recording paper transport amount is detected.

2. The printer according to claim 1, wherein the paper transport controller is responsive to the open path detector for stopping the recording paper transport when the open path detector detects that the path closing section is closed.

3. The printer according to claim 1, wherein the paper transport controller is responsive to the transport amount detector and the recording paper detector for stopping the recording paper transport when recording paper is detected and a second predetermined recording paper transport amount is detected.

4. The printer according to claim 1, further comprising a stop state indicator that indicates the recording paper transport has stopped due to detection of the first predetermined recording paper transport amount when no paper is detected.

5. The printer according to claim 4, further comprising a switch that restarts the recording paper transport after a stop state is indicated by the stop state indicator, and the paper transport controller being responsive to activation of the switch for restarting the recording paper transport.

6. The printer according to claim 3, further comprising a recording paper cutter, and a cutter controller for driving the recording paper cutter to cut the recording paper in response to the recording paper transport stopping due to detection of the second predetermined recording paper transport amount when paper is detected.

7. The printer according to claim 6, wherein the cutter controller is responsive to the open path detector detecting that the path closing section is closed for driving the recording paper cutter to cut the recording paper.

8. A control method for a printer having a recording paper path through which recording paper is transported past a path closing section defined by a print head and a platen disposed opposite to each other, wherein a lever is moved to a first position to close the path closing section to hold the recording paper in the recording paper path, and the lever is moved to a second position to open the path closing section to release the recording paper, comprising the steps of:

a) detecting whether the path closing section is open or closed corresponding to the lever being in the second position for the first position, respectively; and b) starting the recording paper transportation past the path closing section upon detection of the path closing section being open in step a);

c) detecting the presence of recording paper in the recording paper path;

d) detecting the transport amount performed by the recording paper transport; and e) stopping the recording paper transport when no recording paper is detected in step c) and a first predetermined recording paper transport amount is detected in step d).

9. The control method according to claim 8, further comprising stopping the recording paper transport when the path closing section is detected as closed.

10. The control method according to claim 8, wherein step e) comprises stopping the recording paper transport when recording paper is detected in step c) and a second predetermined recording paper transport amount is detected in step d).

11. The control method according to claim 8, further comprising indicating a stop state in which the recording paper transport has stopped due to detection of the first predetermined recording paper transport amount in step d) and detection of no paper in step c).

12. The control according to claim 11, further comprising restarting the recording paper transport after a stop state is indicated.

13. The control method according to claim 10, further comprising cutting the recording paper after step e).

14. The control method according to claim 10, further comprising cutting the recording paper after step e) and when the path closing section is detected as being closed.

* * * * *

UNITED STATES PATENT AND TRADEMARK OFFICE

CERTIFICATE OF CORRECTION

PATENT NO. : 6,179,498 B1
DATED : January 30, 2001
INVENTOR(S) : Toshihiro Tsukada It is certified that error appears in the above-identified patent and that said Letters Patent is hereby corrected as shown below:

Column 10,
Line 5, change "for" to -- or --.

Signed and Sealed this

Eighth Day of January, 2002

*Attest:*

*Attesting Officer*

JAMES E. ROGAN
*Director of the United States Patent and Trademark Office*